United States Patent [19]

Arthur

[11] 4,313,774

[45] Feb. 2, 1982

[54] MOPHEAD AND METHOD OF MANUFACTURING

[75] Inventor: Jack P. Arthur, Bel Air, Md.

[73] Assignee: Wm. E. Hooper & Sons Co., Baltimore, Md.

[21] Appl. No.: 167,397

[22] Filed: Jul. 10, 1980

[51] Int. Cl.[3] ..... A47L 13/20; B32B 31/18; B32B 31/20

[52] U.S. Cl. ..... 156/73.1; 15/226; 15/229 R; 156/250; 156/268; 156/269; 156/290; 156/308.4; 300/21

[58] Field of Search ..... 156/73.1, 73.3, 268, 156/269, 257, 580.1, 580.2, 290, 250, 308.4, 510; 15/226, 228, 229 R, 229 AC, 229 BC; 300/16, 21

[56] References Cited

U.S. PATENT DOCUMENTS

| | | | |
|---|---|---|---|
| 1,767,313 | 6/1930 | Savvucci | 15/226 |
| 2,320,372 | 6/1943 | McCarthy | 15/228 |
| 2,595,776 | 5/1952 | Downey | 15/226 |
| 2,784,035 | 3/1957 | Olsen | 300/16 |
| 3,022,814 | 2/1962 | Bodine, Jr. | 156/73.1 |
| 3,486,796 | 12/1969 | Lechene | 300/21 |
| 3,751,320 | 8/1973 | Buck | 156/268 |
| 4,114,224 | 9/1978 | Disko | 15/226 |

*Primary Examiner*—Michael G. Wityshyn
*Attorney, Agent, or Firm*—Horace S. Harper

[57] ABSTRACT

A method of continuously forming a mophead is disclosed for making a non-woven fabric mophead of a cellulose and synthetic resin fiber blend by sealing and cutting the non-woven fabric including:

(a) combining a plurality of non-woven continuous fabric sheets together in a composite superimposed stack;

(b) intermittently moving the superimposed stack to a sealing station and forming at least one ultrasonic seal transverse to the length of the sheet and in the center area of the superimposed stack;

(c) intermittently moving the superimposed stack to a cutting station; and (d) dividing the superimposed stack into mophead widths and simultaneously cutting a saddle portion and plural strips.

10 Claims, 11 Drawing Figures

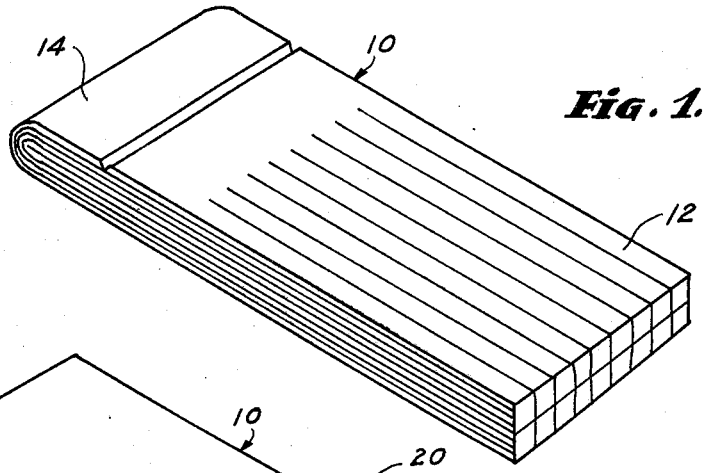
Fig. 1.
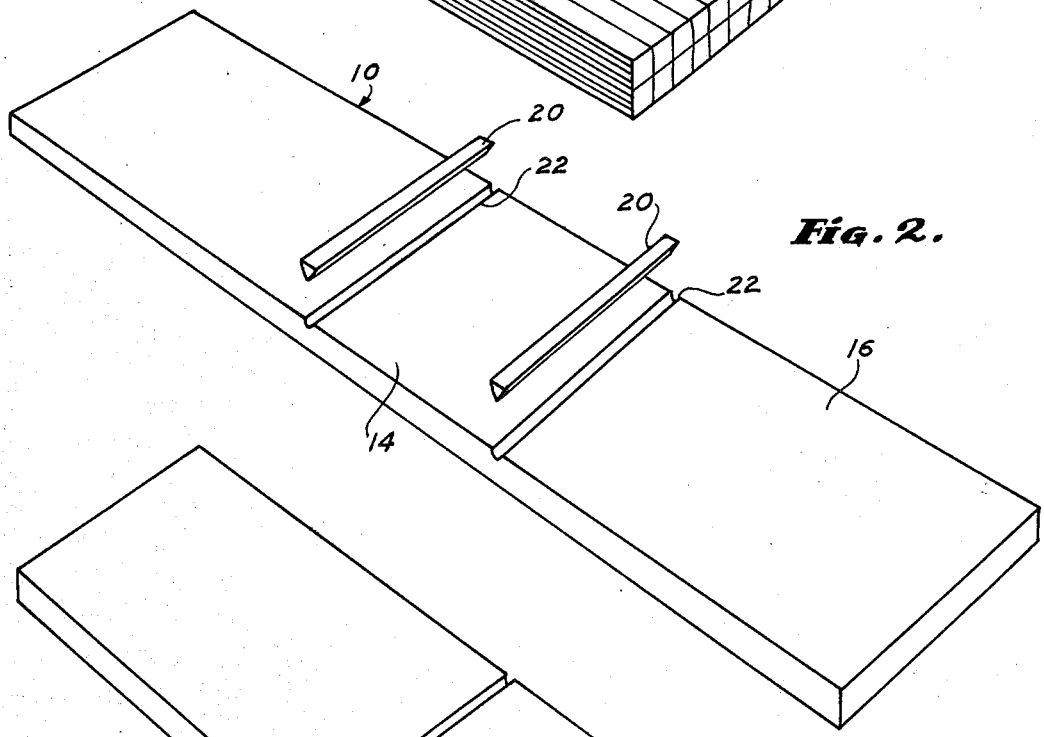
Fig. 2.
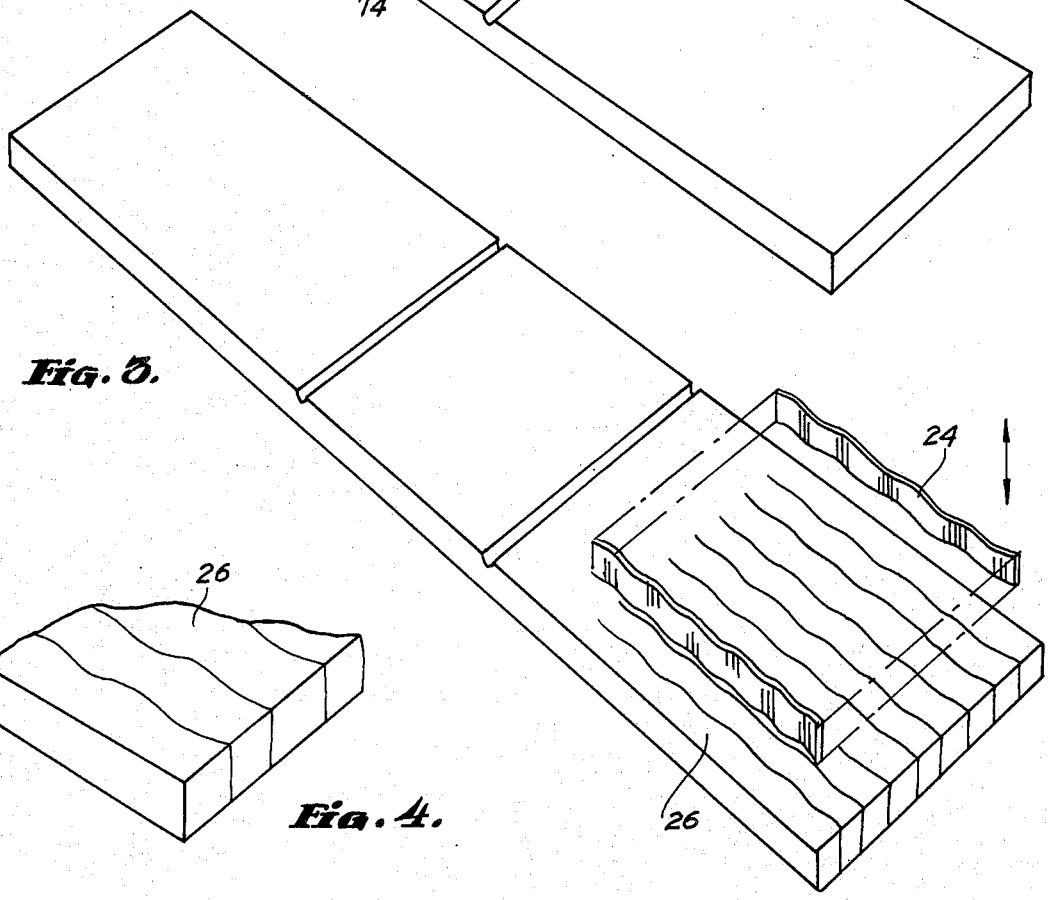
Fig. 3.
Fig. 4.

MOPHEAD AND METHOD OF MANUFACTURING

BACKGROUND OF THE INVENTION

This invention relates to a method for ultrasonically sealing and cutting a dimensionally stable nonwoven fabric and more particularly to a method for manufacturing mops made from dimensionally stable nonwoven fabric sheets with resulting end or center sections and strands integral with center sections depending therefrom.

It has become familiar to associate mops as having cotton or similar fiber twisted or spun into strands which are held together by a band wrapped around the middle section and sewn to the strands. This type mop has been popular for cleaning floors in schools, hospitals and office buildings where the wet mop is used to apply a water base cleaning solution, such as a detergent, to the floor. After the solution is applied the mop is squeezed to remove the excess liquid and then used to absorb the liquid on the floor. This treatment of the mop has produced unsatisfactory results, such as: the wringer used to squeeze liquid out of the mop pulls strands apart leaving lint and broken strands behind on the newly cleaned floor, and cotton and similar fabric mops are likely to turn sour and foul smelling unless washed frequently which has been found to pull strands out. Further, cotton and similar fabric mops leave excess liquid on the floor because of their low absorbent capability.

Mops of different design characteristics have been tried to increase the launderability and absorption qualities of mops. One such mop is disclosed in U.S. Pat. No. 4,097,952, where the mop is constructed of several layers of cellulose sponge-cloth with the layers being generally rectangular in shape and having opposing ends with flat strips cut inwardly from the ends and communicating with an uncut integral center section. The layers are then gathered along the integral center section in such a manner so as to form an undulated gathered center section with the opposing ends directed therefrom. The method used to manufacture the mop includes stacking several sheets of cellulose sponge-cloth having opposing ends and cut inwardly from the ends to form narrow strips; retaining an uncut transverse center section between the strips. The uncut center sections are bound together by a band wrapped around the several sheets and sewn to form a mop head.

Other prior art mop patents disclosing methods of forming mops from sheets of fabric include U.S. Pat. Nos. 2,320,372 and 2,595,776. In the former patent sheets of paper are assembled into a pad and folded as a unit along a center line. The assembled sheets are bound together by stapling or stitching and then slit to provide a plurality of strands and an uncut section which is fastened to a mop handle head. In the latter patent, plural sheets of paper material are divided lengthwise by a fold line to form a center section, and cut to provide a plurality of strands. The folded mop is stapled to a mop handle without any prior bounding of the several sheets to one another.

There have been many attempts to provide an inexpensive method of forming a mop using a nonwoven fabric. To date, the most widely used method has been to sew a band around the fabric or to directly sew the sheets of fabric together. Sewing a band around the fabric is time consuming and sometimes results in the fabric tearing when stressed by the wringer to remove water. Likewise, directly sewing the fabric can result in pulling and tearing the mop fabric squeezed by a wringer. It is therefore a primary object of the present invention to provide an inexpensive method for forming mops by an automatic continuous method without sewing or adhesively bonding the nonwoven sheets together where the bonds formed will withstand the stresses of being squeezed in a wringer.

SUMMARY OF THE INVENTION

The principal object of this invention is to provide a method for manufacturing an improved mop of a dimensionally stable nonwoven fabric ultrasonically welded to form a saddle portion and die-cut to form high water absorbent strands without the disadvantages of conventional mops.

Another object of this invention is to provide a method for manufacturing a mop that is economical to manufacture, sturdy and efficient in use, and particularly well adapted for its intended purpose.

Other objects and advantages of this invention will become apparent from the following description taken in connection with the accompanying drawings, wherein certain embodiments of this invention are illustrated.

In general, the method of this invention involves ultrasonically welding a mophead made of a plurality of dimensionally stable sheets of nonwoven fabric, such as cellulose and synthetic fibers needled into a thickness of entangled fibers where friction between the fibers gives the fabric strength. The ultrasonic welding fuses the nonwoven fabric sheets together along at least one line transverse to the length of the sheets at or about midway between the opposed ends to form a center or saddle portion. According to the method of the invention saddle portions of the dimensionally stable nonwoven fabric are compressed one against the other by an ultrasonic horn whereby the portions become contiguous along the interface formed therebetween, and ultrasonic energy is transmitted through the compressed fibers forming bonds between the contiguous surfaces of the layers of cellulose and synthetic resin fiber material. The sheets are bonded to one another by an ultrasonic bonding apparatus which compresses the sheets and raises the temperature of the contiguous portions to the bonding temperature for the synthetic resin material of the fabric. The welded together sheets of nonwoven fabric are moved from the ultrasonic horn to a die-cutting head where a vertically reciprocating cutting head cuts through the layers of nonwoven fabric, forming strands which may have serrated edges to provide each strand with increased surface area and consequently additional cleaning capacity.

Apparatus adapted to carry out the method of this invention generally comprises a conveyor with clamping means for clamping plural sheets of a nonwoven fabric to the conveyor belt and an ultrasonic horn for bonding the sheets together. The ultrasonic horn includes an ultrasonic transducer in the form of a motor or vibrator which includes electro-mechanical motors, such as electro-dynamic piezoelectric and magnetostrictive. For the purposes of the invention "ultrasonic" is taken to mean vibrations in the range of approximately 5,000 to 1,000,000 cycles per second. The apparatus also has a die-cutting head which operates during the dwell time of the ultrasonic horn to cut the bonded together sheets of nonwoven fabric into mopheads of a desired width and simultaneously providing an uncut center or saddle and plural strands.

BRIEF DESCRIPTION OF THE DRAWINGS

FIG. 1 is a perspective view of a mop formed by the method according to the present invention;

FIG. 2 is a perspective view of the method of ultrasonic welding a plurality of layers of fabric in accordance with the method of present invention;

FIG. 3 is a perspective view showing the lower ends of the mophead which has been die-cut into absorbent strips in accordance with the method of the present invention;

FIG. 4 is an enlarged, fragmentary, perspective view of the serrated strips of FIG. 3;

DESCRIPTION OF THE INVENTION

Figure 6:
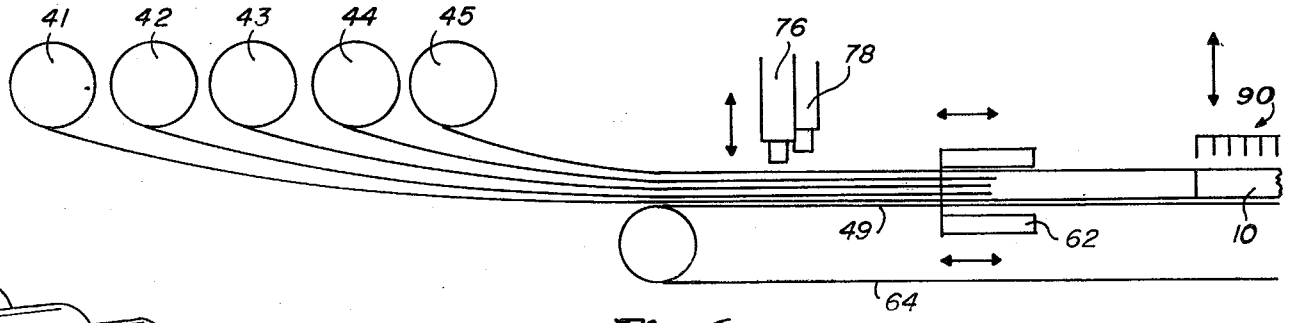
FIG. 6 is a diagrammatic side elevation illustrating the method of the present invention for forming mopheads.

Referring to the drawings, FIG. 1 depicts a mop 10 for scrubbing floors and absorbing cleaning water and other fluid thereon. The mophead 10 is comprised of highly absorbent strips 12 and a U-shaped saddle section 14. The saddle section 14 is gripped by the clamp end of a suitable mop handle, not shown, to support the mop during use.

The mop 10 is made of several sheets of absorbent dimensionally stable sheets stacked in a superimposed fashion as shown in FIG. 2. Each layer is sufficiently strong to withstand vigorous scrubbing and scouring activities. A thin cellulose and synthetic resin blend, nonwoven fabric formed by a needling process has been found to be the most acceptable. The fabric is distinguished from regular woven fabrics by the arrangement or orientation of fibers within the fabric structure. Instead of being twisted, the fibers are laced and looped into chains of entanglement. In a twisted structure as well as in a looped and laced structure, fibers are pressed together when the material is put under stress; this gives rise to friction and fabric strength results. In nonwoven materials, the fiber orientation and associated systematic development of entanglement is of utmost importance. It is achieved by means of fine, barbed needles.

A fabric of cellulose and synthetic resin fibers, unlike cotton fibers used in conventional mops, is a clean, sanitary material not as likely to leave lint or bits of broken fiber in its path. Nor is a combined cellulose and synthetic resin fabric as likely to provide a good medium for growth of bacteria and fungi which cause sour and unpleasant odors common in damp cotton mops. Nonwoven fabrics have been found to be relatively tough, yet absorbent, flat throughout their thickness, blending into a less compact, but even more absorbent, felt-like layer. Upon contact with a wet surface, the flat strands soak up moisture and tightly adhere to the mopped surface over a relatively large area compared to a cylindrical strand, thereby producing efficient, clean and liquid removal.

FIG. 2 illustrates a plurality of sheets 16 stacked in superimposed sheets or a composite strip and bound together by ultrasonic bonding. The superimposed sheets are conveyed under an ultrasonic apparatus which includes a pair of ultrasonic transmitting members 20 for bonding the sheets 16 together at their interface. The ultrasonic transmitting members 20 have tapered edges for compressing the superimposed sheets together in a thin line in the areas to be bonded.

The ultrasonic transmitting members 20 are a part of an ultrasonic bonding apparatus, which will be described in more detail. Ultrasonic bonding apparatuses typically include transmitting members on a stationary support and electrical transducers or an ultrasonic motor for imparting ultrasonic energy in the range of approsimately 5,000 to 1,000,000 cycles per second to the cellulose and synthetic resins fabric to bond the layers at their interfaces.

As seen in FIG. 2, the uncut superimposed sheets 16 of nonwoven fabric are ultrasonically welded near the midsection of the superimposed layers. There may be one or two parallel welds 22 which are transverse to the length of the superimposed sheets 16 of nonwoven fabric defining a saddle portion 14 of the mop 10. The ultrasonic welds 22 penetrate the nonwoven fabric from the top surface through and including the bottom surface such that all of the sheets are now integrally welded together. The saddle portion 14, defined by the parallel welds 22, is folded to form a U-shaped center section which is gripped in the mop handle clamp.

After the superimposed sheets of nonwoven fabric sheets 16 have been ultrasonically welded together the uncut mop 10 is cut into longitudinal strands as shown in FIG. 3 where a die-cutting apparatus 24 is shown. Only one end of the ultrasonically bonded superimposed layers is shown with die-cut strands. It is understood that the mop would be simultaneously cut to form strands 26 on both ends. The die-cutting apparatus 24 is moved downwardly cutting the superimposed sheets 14 into strands 26 on either side of the saddle portion 14. The saddle portion 14 is an uncut width of about one to four inches between the ultrasonic welds 22. The beginning of the stands 26 does not extend to the ultrasonic welds 22 to prevent any stress or tearing of the ultrasonic bond.

In FIG. 4 the strands 26 of the superimposed sheets 14 of nonwoven fabric are cut with serrated edges. The die-cutting apparatus 24 has blades with wavy edges which form the serrations on the edges of the strands to provide more surface area on each strand which increases the fluid absorbing capacity.

Figure 5:
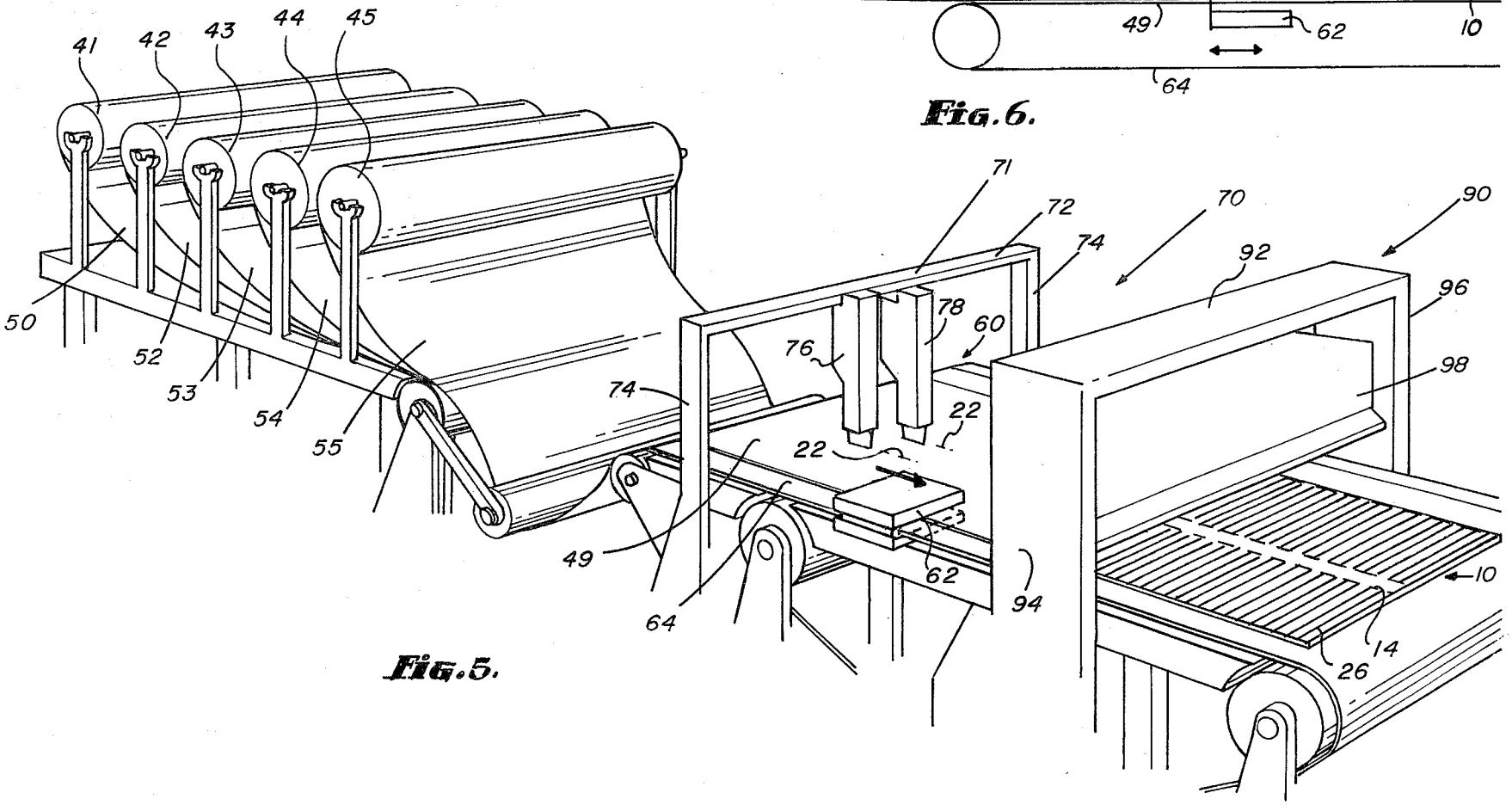
FIG. 5 is a perspective view of an apparatus for carrying out the method for the present invention.

FIGS. 5 and 6 illustrate the manufacture of mopheads in accordance with this invention. As shown in FIGS. 5 and 6, five continuous strips 50, 52, 53, 54 and 55 of nonwoven fabric material are drawn from respective supply rolls 41, 42, 43, 44 and 45 onto a conveyor 60. The paying of the nonwoven fabric sheets onto the conveyor is controlled by the forward movement of the conveyor belt 62 the nonwoven fabric sheets 50, 52, 53, 54 and 55 are stacked one on top of the other forming a composite strip 49 having a width identical to that of the finished length of the mophead 10. To insure proper alignment of the sheets photoelectric cells (not shown) are provided on the sides of the conveyor to detect any misalignment and to operate a roll shifter (not shown) on each of the rolls to move the misaligned roll horizontally to the right or left to bring the sheet into alignment. There is a pair of conveyor belt clamps 62 which clamp the composite strip 49 of nonwoven sheets to the conveyor belt 64. Clamp motors (not shown) move the conveyor belt clamps 62 in the direction of arrow 66; therefore, with the clamps 62 gripping both the conveyor belt 64 and the composite strips 49 and the clamp motors energized the nonwoven composite strips 49 are conveyed through the mophead forming apparatus 70. The forward movement of the conveyor belt 64 is intermittently controlled to allow time to ultrasonically seal the composite strips 49 together and to cut the strips 49 into mopheads of desired width.

Figure 7:
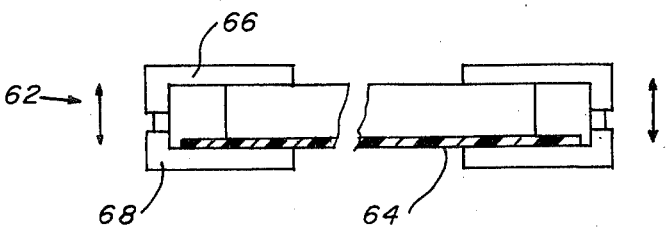
FIG. 7 is a cross-sectional view of clamping devices of the present invention.

FIG. 7 shows a cross section of the clamps 62 gripping the conveyor belt 64 and the superimposed sheets 49. The clamps 62 are shown as vertically adjustable C-clamps having an upper vertically adjustable section 66 and a lower stationary section 68. The upper section 66 is hydraulically controlled to clamp the composite superimposed sheets 49 to the conveyor belt 64 and to release the composite superimposed sheets at the end of a cycle to be described.

Figure 8:
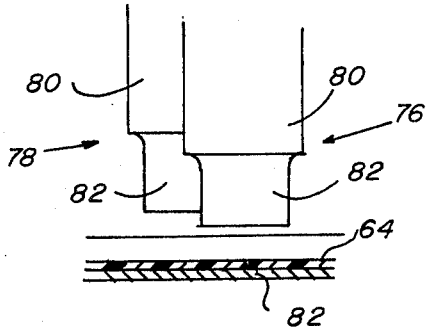
FIG. 8 is a view of the ultrasonic sealing horns of the present invention.

There is provided at the receiving end of the conveyor 60 an ultrasonic sealing station 70 including a horizontal supporting bar 72 supported by vertical uprights 74, and a pair of ultrasonic horns 76 and 78 spaced from one another to provide a saddle portion 14 on the mophead blank of FIG. 2. The width of the space between the ultrasonic horns can be adjusted for producing various size mopheads. The ultrasonic sealing horns, FIG. 8, have ultrasonic electroacoustic transducers 80 which convert electrical power to mechanical vibratory power. Each ultrasonic horn has a head 20 powered by the transducer to provide an ultrasonic seal through the composite superimposed sheets 49 when the ultrasonic horns 76 and 78 are pressed into nonwoven fabric. The conveyor belt 64 is supported on a table surface 82 to provide a flat stationary anvil-like surface for sealing the composite superimposed sheets together.

Figure 9:
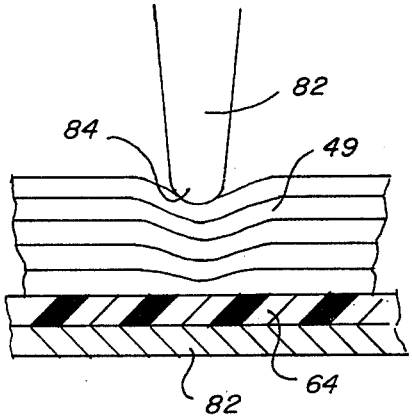
FIG. 9 is a detailed view of one of the sealing horns of the present invention.
Figure 10:
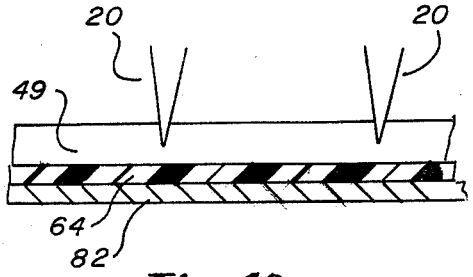
FIG. 10 is a view of two ultrasonic sealing horns sealing of plurality of sheets in accordance with this invention.

In FIG. 9 the head 20 of the ultrasonic horn is shown pressing into the composite superimposed sheets 49 to form an indented compressed area which is bonded together by the ultrasonic horn. The tip 84 of the ultrasonic horn head 20 is shown with arcuate surface area to prevent the composite superimposed sheets 49 from being torn during the sealing process. This ultrasonic sealing is carried out utilizing an ultrasonic sealing horn such as the Model 5170 Ultrasonic Plastics Assembly System sold by Branson Sonic Power Company of Danbury, Connecticut. The ultrasonic transducer vibrates in a range of approximately 5,000 to 1,000,000 cycles per second.

Figure 11:
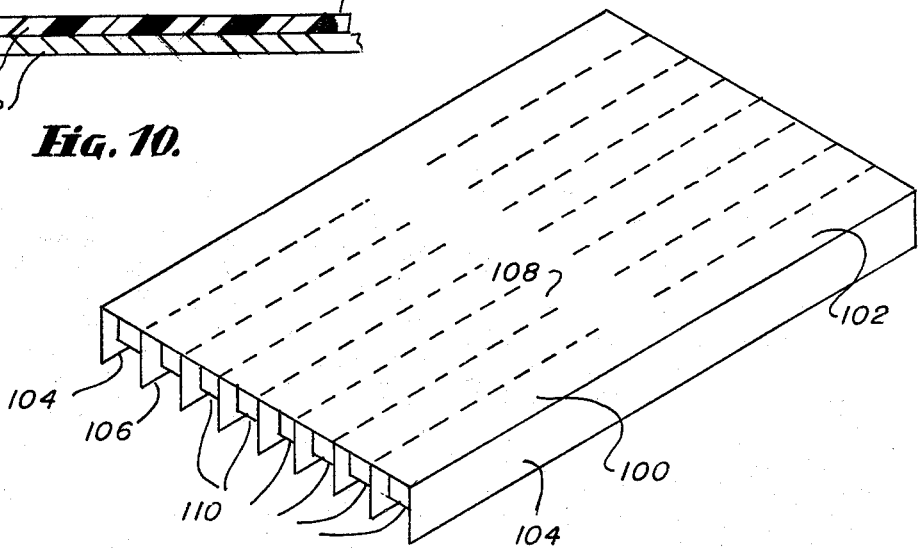
FIG. 11 is a perspective view of the cutting heads in accordance with the present invention.

After the composite superimposed sheets 49 have been sealed together they are moved by the conveyor belt 64 and clamps 62 to a strip cutting station 90. The composite superimposed sheets 49 are cut to a desired width for producing a finished mophead and cut to provide a plurality of strips. In cutting the plurality strips the cut extends from the ends and stops short of the ultrasonic seals as shown in FIG. 3. Turning to the cutting station, there is provided a horizontal support 92 and a pair of uprights 94 and 96 for supporting a vertically reciprocating cutting head 98. Details of the cutting head 98 are best shown in FIG. 11 where the cutting pairs 100 and 102 are shown. The cutting pairs 100 and 102 include outside vertical knives 104 which define the width of the mophead and a plurality of inside vertical knives 106. The knives 104 extend the full length of the cutting pairs 100 and 102, while the knives 106 on cutting pair 100 and the knives 106 and cutting pair 102 are separated by an area 108. The saddle portion 14 of the mophead is defined by the uncut area 108. To assist in cutting the strips 26 and to prevent the strips from wedging between the knives strips of resilient plastic or rubber 110 are inserted between the knives. The strips 110 being resilient tend to push the cut nonwoven strips from between the knives after they have been cut. The cutting pairs 102 and 104 are hydraulically operated to reciprocate vertically during the dwell time of the ultrasonic horns 76 and 78, as will be explained.

To operate the apparatus 70 composite superimposed sheets 49 of a nonwoven fabric having a cellulose and synthetic resin fiber blend is conveyed to the ultrasonic sealing station 71 by the clamps 62 gripping the sheets 49 and the conveyor belt 64. The ultrasonic seals 22 are automatically formed in the composite superimposed sheets 49 by the timed dwell of the ultrasonic head 76 and 78. After the seals 22 are made the composite superimposed sheets 49 are conveyed to the cutting station 90 where the mopheads are formed and the strips 26 are cut. The mophead making machine 70 is operated to simultaneously ultrasonically form the saddle portion 14 of one mophead while another mophead is being cut and the strips 26 formed. Therefore, during the dwell time of the ultrasonic horns, which ranges between 1 to 7 seconds, the cutting pairs 102 and 104 are operated to cut the mophead of an already ultrasonically bonded together composite superimposed sheets 49.

The mop 10 of this invention is made of undied white nonwoven fabric having a cellulose and synthetic resin fiber blend, each sheet is about 0.120 to 0.185 ths of an inch thick for industrial mops. Mops manufactured from a colored nonwoven fabric having the same cellulose and synthetic resin fiber blend will range between 0.090 and 0.136 ths of an inch thick. It has been found that a nonwoven fabric having a thickness of about 0.06 to 0.08 ths of an inch could be employed in manufacturing household mops since the launderability techniques are not as severe as with industrial mops. The sheets are dimensionally stable against any noticeable shrinkage, with the average shrinkage being less than two percent under normal machine washing and drying conditions at a temperature range up to 160° F.

In a test to determine the compatibility of ultrasonically welding nonwoven rayon and polyester blend fabrics it was determined that a strong weld can be achieved. The test was performed with an ultrasonic welding member having a $\frac{1}{4}$ inch radius face and a matching anvil. Five layers of fabric of 0.13 ths of an inch thick were welded together by plunge welding at a weld time of two seconds and a hold time of one second. The weld time was determined to be the actual time the ultrasonic welding apparatus was in pressure contact with the nonwoven fabric with the power turned on. The hold time was determined to be the actual time the ultrasonic apparatus remained in contact with the nonwoven fabric after the power was turned off. For the best results, it was found that total time in seconds of the weld time plus the hold time is between the range of 2.0 seconds to 7.0 seconds with 4.5 to 5.5 seconds being the optimum for manufacturing mops having five sheets of nonwoven fabric.

In the preferred embodiment the nonwoven fabric is a blend of 35 percent cellulose and 65 percent polyester. The cellulose in the preferred embodiment is rayon, however, other cellulose fibers, natural and synthetic can be used. Other blends of cellulose and synthetic resin fibers include 50 percent cellulose and 50 percent synthetic resin. Blends of less than 50 percent synthetic resin have had marginal success of ultrasonic welding.

It will be appreciated that while the method described discusses a mop having five sheets of nonwoven fabric, the invention should not be limited to a method for making a mop of a certain number of nonwoven fabric sheets; particularly where it has been found that the described method is applicable to mop making using from two to several sheets of nonwoven fabric.

While only one embodiment of the invention is disclosed it is appreciated that other modifications of and variations of the invention will be apparent to those skilled in the art, and they may be made without departing from this spirit and scope of the present invention which is claimed herein.

I claim:

1. The method of continuously forming a mophead made of a nonwoven fabric of a cellulose and synthetic resin fiber blend by sealing and cutting the nonwoven fabric comprising the steps of:

(a) combining a plurality of nonwoven continuous fabric sheets having a length, a width and a center area together in a composite superimposed stack;

(b) intermittently moving said composite superimposed stack to an ultrasonic sealing station and forming at least one ultrasonic seal continuously and transversely to the length of the sheet in the center area of said composite superimposed stack;

(c) intermittently moving said composite superimposed stack from said ultrasonic sealing station to a cutting station; and (d) dividing said composite superimposed stack transversely into mophead widths while simultaneously cutting the mopheads to include a saddle portion defined by said at least one ultrasonic seal and a pair of plural strips extending inwardly from the ends of the mophead and communicating with the uncut saddle portion.

2. The method of forming mopheads in accordance with claim 1 wherein said intermittent movement of said composite superimposed stack from said ultrasonic sealing station to said cutting station is accomplished between the dwell times of the ultrasonic sealing step, said cutting taking place during the dwell time of the ultrasonic sealing step.

3. The method of forming mopheads in accordance with claim 2 wherein two continuous and parallel ultrasonic seal lines are simultaneously formed longitudinally in the center area of the composite superimposed stack to form a saddle portion.

4. The method of forming mopheads in accordance with claim 3 wherein said dwell time is between 2.0 seconds and 7.0 seconds.

5. The method of forming mopheads as in accordance with claim 4 wherein said sheets of nonwoven fabric have a thickness range of between 0.090 to 0.136 inch per sheet, and contain at least 50 percent of a synthetic resin, said composite superimposed stack having between three and five sheets.

6. The method of forming mopheads in accordance with claim 5 wherein each nonwoven fabric sheet forming said composite superimposed stack contains 65 percent synthetic resin, the dwell time for the ultrasonic sealing step is at or about between 2.0 and 7.0 seconds.

7. The method of forming mopheads in accordance with claim 6 where industrial mopheads are formed, the sheets of nonwoven fabric have a thickness range of between 0.120 and 0.185 inch per sheet, at least four nonwoven sheets form the composite superimposed stack, and a dwell time of the ultrasonic sealing step is between 4.5 and 5.5 seconds.

8. The method of forming mopheads in accordance with claim 7 where five nonwoven fabric sheets form said composite superimposed stack.

9. The method of forming mopheads in accordance with claim 5 where household mopheads are formed, the sheets of nonwoven fabric have a thickness range of between 0.060 and 0.080 inch per sheet, at least three nonwoven sheets form the composite superimposed stack, and a dwell time of the ultrasonic sealing step is between 4.5 to 5.5 seconds.

10. The method of forming mopheads in accordance with claim 9 where four nonwoven fabric sheets form said composite superimposed stack.

* * * * *